US005885351A

United States Patent [19]

Long et al.

[11] Patent Number: 5,885,351

[45] Date of Patent: Mar. 23, 1999

[54] TRIBOCHARGE APPLICATOR DEVICE

[75] Inventors: Lloyd Bryan Long, Knott; Jerry Don Bales; Sammy Kent Flud, both of Big Spring; Wesley Hamilton Wagner, Midland, all of Tex.

[73] Assignee: PFS Thermoplastic Powder Coatings, Inc., Big Spring, Tex.

[21] Appl. No.: 800,813

[22] Filed: Feb. 18, 1997

[51] Int. Cl.[6] ..... B05B 5/025; B05B 5/00

[52] U.S. Cl. ..... 118/621; 118/308; 239/706

[58] Field of Search ..... 239/692, 700, 239/706, 702, 703, 399; 118/620, 621, 627, 629, 308; 427/421, 458, 472

[56] References Cited

U.S. PATENT DOCUMENTS

| | | | |
|---|---|---|---|
| 3,075,706 | 1/1963 | Point | 239/700 |
| 3,740,612 | 6/1973 | Gauthier et al. | 239/706 |
| 3,903,321 | 9/1975 | Schaad | 427/25 |
| 4,598,871 | 7/1986 | Hartle | 239/706 |
| 4,886,215 | 12/1989 | Ruud | 239/692 |
| 5,282,573 | 2/1994 | Reimer | 239/85 |
| 5,297,733 | 3/1994 | Burks | 239/85 |
| 5,402,940 | 4/1995 | Haller et al. | 239/697 |
| 5,520,736 | 5/1996 | Long et al. | 118/308 |

OTHER PUBLICATIONS

"*Powder Coating Systems*", William D. Lehr; pp. 96–99; McGraw–Hill, Inc., publisher (date unknown).

"*Powder Coating–The Complete Finisher's Handbook*", 1st Ed. (Powder Coating Institute Jun. 1994); pp. 88–89.

Nordson Corporation catalogue, pp. *ii*, 72–73 and 80–81; Nov. 1996.

Product Brochure from Intec, a Division of Advanced Powder Coatings (date unknown).

*Primary Examiner*—Laura Edwards
*Assistant Examiner*—Calvin Padgett
*Attorney, Agent, or Firm*—Locke Purnell Rain Harrell, P.C.; Monty L. Ross

[57] ABSTRACT

A tribocharge applicator device for application of a powdered material to a substrate is disclosed. The device includes an inlet for pressurized conveying gas, an inlet for powdered polymeric material having a first dielectric constant, a mixing chamber, a discharge barrel and a charge module. The charge module includes: at least two spiral charging elements disposed inside and coaxially aligned with respect to the barrel, each spiral charging element comprising an elongated sheet of a different material having a second dielectric constant. The proximal end of the elongated sheet is twisted about its longitudinal axis with respect to the distal end such that each longitudinal edge of the sheet forms a spiral. Each charging element is positioned within the barrel adjacent to another like element such that a distal end of a first element abuts a proximal end of a second element wherein the first charging element defines a first spiral flow path and said second charging element defines a second spiral flow path rotationally opposite to the first spiral flow path. An electric charge is transferred to the powdered polymeric material as the powdered material flows through the charging element.

22 Claims, 4 Drawing Sheets

TRIBOCHARGE APPLICATOR DEVICE

TECHNICAL FIELD

The present invention relates generally to coating systems useful for applying powdered material primarily comprising thermoplastic and thermosetting polymeric powdered resins to a substrate, and more particularly, to a system utilizing a tribocharge applicator device with a charge module that causes the resin particles to acquire an electrostatic charge opposite to that of the substrate.

BACKGROUND OF THE INVENTION

Four types of commercially available prior art systems are used for applying polymeric resin powder coatings: 1) fluidized bed; 2) flame spray; 3) electrostatic; and 4) tribocharge (sometimes referred to as "tribo-electric"). Fluidized bed coating systems used for applying polymeric resin powder coatings are limited as to the location at which coating can be done and the size of the parts that can be coated. Flame spray, electrostatic and tribocharge applicator systems are more portable and typically comprise a powder source such as a hopper, an applicator device, or a conduit (usually a flexible hose) connecting the powder source to the applicator device.

In most conventional powder delivery systems, compressed air is forced through an eductor adjacent to the powder source. Powdered polymeric resin is entrained in the flow of compressed air and delivered through the hose to the applicator device.

More recently, a powder delivery system has been disclosed in U.S. Pat. No. 5,520,736, incorporated by reference herein, that is useful for supplying powder to a flame spray applicator device as disclosed in U.S. Pat. No. 5,297,733 that employs an eductor inside the applicator device to draw powder from the powder source. Flame spray powder delivery systems require the use of combustible gasses to heat resin particles prior to directing them against the substrate. With these systems, it is sometimes difficult to obtain a coating of even thickness, particularly if the substrate embodies complex surfaces.

Electrostatic and tribocharge applicator systems apply an electrical charge to the powder particles, thereby causing them to adhere to the substrate. Electrostatic powder delivery systems use an electrical transformer in or near the applicator device and a metal needle at the exit of the gun to create an ionizing field that applies a negative charge to the resin particles as they are carried by conveying air toward an electrically grounded substrate. Tribocharge coating systems utilize mechanical rubbing instead of a transformer to impart a static electrical charge to the polymeric resin particles. As powder particles are carried by air pressure through the applicator device, they rub against the interior wall of the spray gun applicator and the resultant friction creates a positive charge on the powdered particles. Electrostatic and tribocharge systems are discussed generally by William D. Lehr in *Powder Coating Systems* (McGraw-Hill, 1991), p. 96–99. Conventional prior art tribo-electric powder spray guns are disclosed in U.S. Pat. Nos. 3,903,321 and 5,402,940.

With regard to applicator devices incorporating a "swirler" in the applicator, U.S.S.R. Patent No. 1,162,502 discloses a flame spray gun having a "swirler" which contains on its biconical surface multi-start spiral grooves cut with an inclination of between 15 to 60 degrees from the central axis of the swirler. As the particles pass though the mixer, their flow is dictated by the grooves' which contributes to enhanced mixing. Therefore, the particles, upon exiting the gun, are more evenly distributed and more equally heated. FIGS. 6 through 8 of U.S. Pat. No. 5,282,573 illustrate a one direction spiral "bifurcating twisted vane" used in a conventional flame spray gun, wherein powdered resin is drawn from a hopper having an eductor in the hopper. The air carries or pushes the powdered resin through the supply hose to the applicator device as opposed to incorporating the eductor directly in the applicator device as is done in the present invention.

SUMMARY OF THE INVENTION

The present invention includes a system and tribocharge applicator device for applying polymeric powdered resin coatings primarily comprising thermoplastic and thermosetting polymeric resins to a substrate. The device includes an inlet for pressurized conveying gas, an inlet for powdered polymeric material having a first dielectric constant, a mixing chamber, a discharge barrel and a charge module. The improvement over the prior art comprises a unique charge module having at least two spiral charging elements disposed inside and coaxially aligned with respect to the barrel, each spiral charging element having an elongated sheet of a different material of a second dielectric constant. The proximal end of the elongated sheet is twisted about a longitudinal axis with respect to the distal end such that a longitudinal edge of the sheet forms a spiral. Each charging element is positioned within the barrel adjacent to another like element such that a distal end of a first element abuts a proximal end of a second element wherein the first charging element defines a first spiral flow path and said second charging element defines a second spiral flow path rotationally opposite to the first spiral flow path. An electric charge is transferred to the powdered polymeric material as the powdered material flows through the charging element.

The invention further discloses and claims a spray gun applicator device for applying polymeric powdered resin coatings. The spray gun body includes a grip handle, a breech end, a barrel end, a first internal passage for delivering pressurized conveying gas from an external source, a first opening in the breech for receiving a powder nozzle, a powder bore having an inlet end located at the first opening in the breech and a discharge end located at the barrel end of the body. The applicator device further includes a powder nozzle and an eductor nozzle positioned in the powder bore. Pressurized conveying gas passing around the eductor nozzle draws by venturi effect the powdered material from an external supply source through the internal bore of the powder nozzle discharges it into the powder bore of the body. A barrel is attached to and in communication with the discharge end of the powder bore. A charge module as previously described above is positioned in the internal bore of the barrel. An electric charge is transferred to the powdered polymeric material as the powdered material flows through the charging element located in the barrel.

BRIEF DESCRIPTION OF THE DRAWINGS

A more complete understanding of the present invention and the advantages thereof may be had by reference to the following Detailed Description when taken in conjunction with the accompanying Drawings wherein.

DETAILED DESCRIPTION

Figure 1:
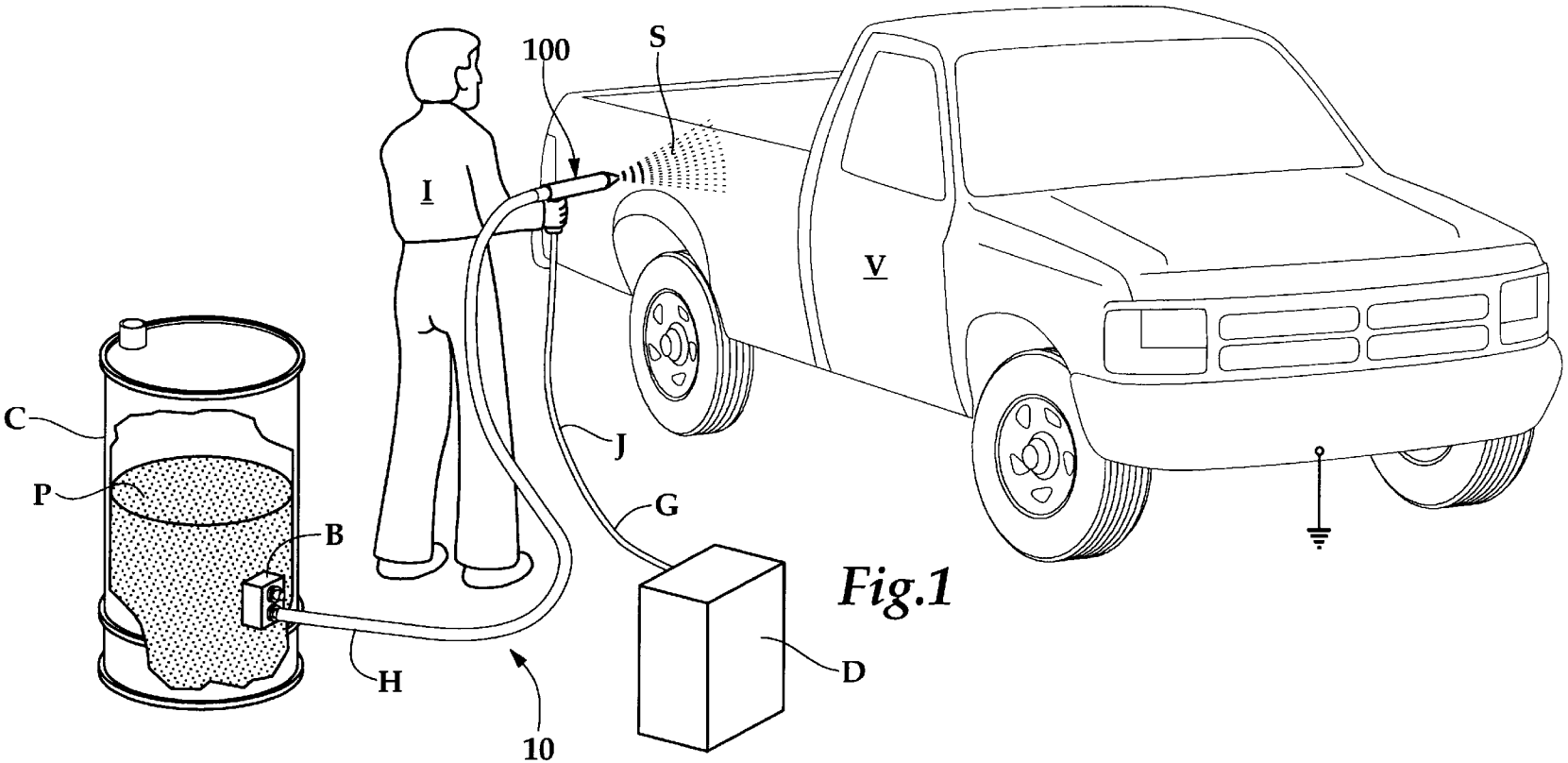
FIG. 1 is a perspective of a tribocharge applicator device and associated system elements being used to apply a spray coating to a substrate.

Reference is now made to the Drawings wherein like reference characters denote like or similar parts throughout the seven FIGURES. The present invention discloses a system and tribocharge applicator device for applying polymeric powdered resin coatings primarily comprising thermoplastic and thermosetting polymeric resins (hereinafter "powdered material"). Referring now to FIG. 1, therein is illustrated a tribocharge applicator system 10 incorporating the tribocharge applicator device 100. An individual I is depicted applying a spray of fluidized powdered material S to a substrate, depicted as a motor vehicle V. The system 10 comprises a supply canister C containing powdered polymeric powdered material P to be applied to vehicle V. The canister C may include a vent block B for use in controlling surging during application of the powdered polymeric material P. Canister C and vent block B may be of the type described and illustrated in U.S. Pat. No. 5,520,736, the disclosure of which is incorporated by reference. Flexible delivery hose H delivers the powdered polymeric material P from the supply canister C to the tribocharge applicator 100 of the present invention. Another flexible delivery hose J delivers pressurized conveying gas G from compresser D to the applicator 100 wherein the pressurized gas G and powdered material P are mixed, tribocharged and discharged as spray of fluidized powder S. It will be understood by individuals skilled in the art that other types of delivery systems may be used with the applicator of the present invention, including those as discussed in the background section of this application.

Figure 2:
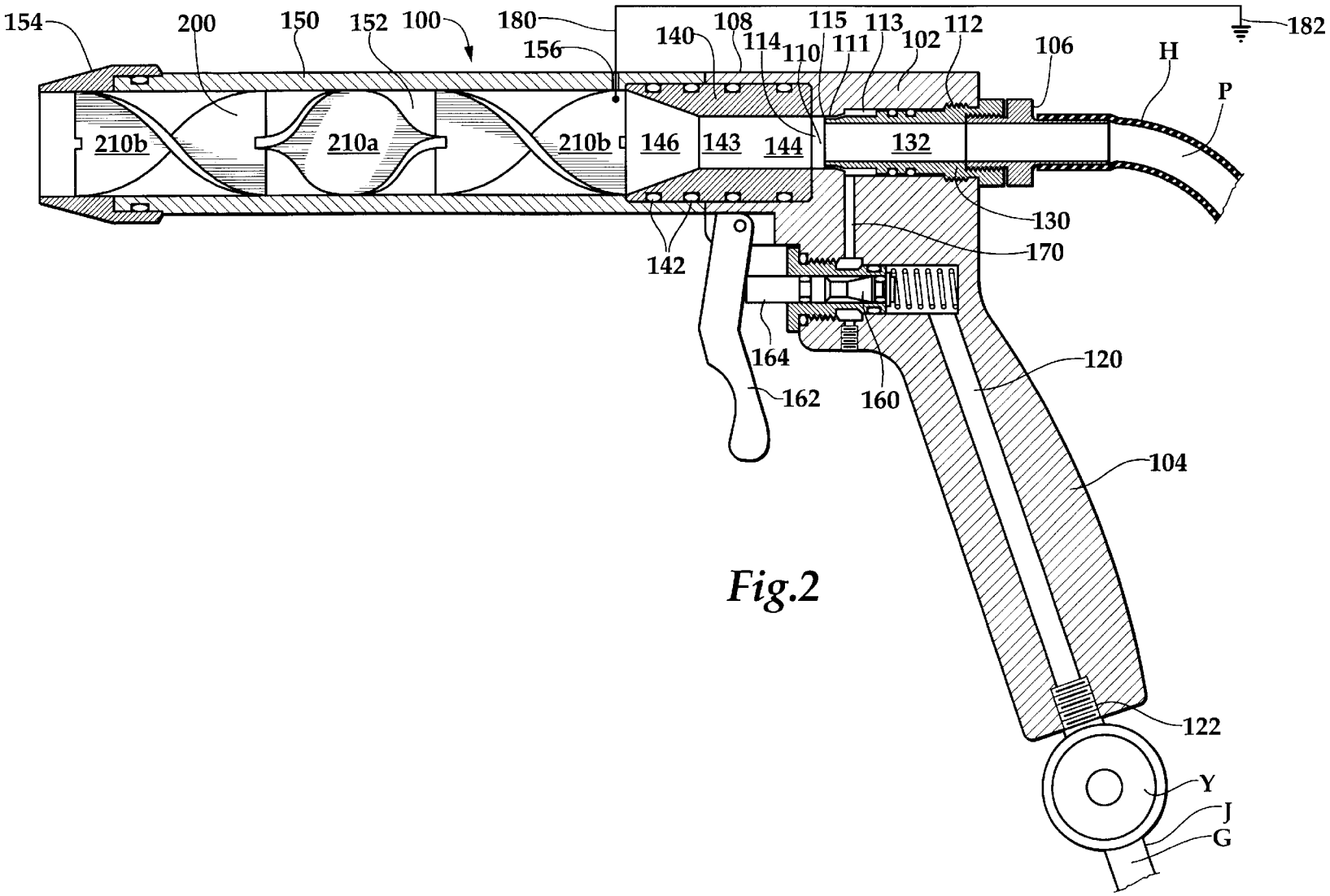
FIG. 2 is a cross section elevation view of the tribocharge applicator device of the present invention wherein a plurality of charging elements are disposed internally in a spray gun applicator.

Turning now to FIG. 2, therein is illustrated a cross section of the tribocharge applicator 100 of the present invention The applicator 100 comprises a spray gun body 102 including a grip handle 104, a breech end 106 and a barrel end 108. The body further includes a powder bore 110 for delivery of the powdered polymeric coating material P through flexible hose H. The powder bore 110 includes an inlet end 112 open to the breach end 106 of the body 102 and an open discharge end 114 located at the barrel end 108 of the body 102. The inlet end 112 is internally threaded for receiving a powder nozzle 130. The discharge end 114 receives an adapter block 140 for connection of a barrel 150 to the body 102. It will be understood by those skilled in the art that barrel 150 may be formed integrally with the body 102 thereby eliminating the adaptor block element or, alternatively, the barrel 150 may be connected onto the barrel end 108 of body 102 in any number of ways, including by threaded connection.

The body 102 further includes an internal passage 120 passing from a threaded opening 122 in the butt end of grip handle 104 to a spring loaded valve 160 for selectively controlling the flow of pressurized conveying gas G. The opening 122 receives the male end of a threaded connector disposed on a regulator Y on pressurized delivery hose J. The spring loaded valve 160 is actuated by trigger 162 and piston 164. A second passage 170 delivers pressurized conveying fluid G from the valve 160 to the powder bore 110.

Figure 3:
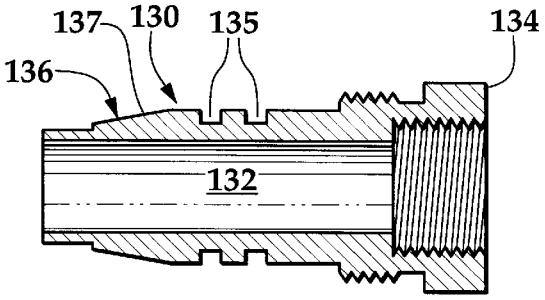
FIG. 3 is a cross section view of a powder nozzle having an eductor end used in the spray gun applicator of FIG. 2.

Referring now to FIG. 3, therein is illustrated the powder nozzle 130. The powder nozzle 130 includes an internal bore 132 for delivery of powdered material P to the powder bore 110 of the body 102. The bore 132 is threaded internally at inlet end 134 for receiving a male connector for attachment of hose H. The exterior surface of the inlet end 134 may be hexagonally shaped with wrench flats or knurled for tightening powder nozzle 130 upon insertion into powder bore 110. A central portion of the exterior tubular surface of the powder nozzle 130 may include one or more concentric grooves adapted for receiving O-ring gaskets for enhancing the seal between the powder nozzle 130 and the powder bore 110. Disposed on a discharge end of powder nozzle 130 is an eductor nozzle 136. The eductor nozzle 136 includes a conically tapered exterior section 137 having an outside diameter smaller than the inside diameter of the surrounding powder bore 110.

Referring now to both FIGS. 2 and 3, when powder nozzle 130 is inserted into powder bore 110 an annular space 115 is created between a conically tapered portion 111 of the powder bore 110 and the conically tapered portion 137 of eductor nozzle 136. The powder bore 110 further includes a concentric annular groove 113 that is disposed in the powder bore 110 adjacent to and in communication with conically tapered portion 111. The concentric groove 113 is open radially to passage 170. Pressurized gas G is selectively delivered to the concentric groove 113 from an external source via passage 120, valve 160 and passage 170. The powdered material P is drawn from an external source though the internal bore 132 of powder nozzle 130 and passes out the discharge end 136 of the powder nozzle 130 by venturi effect caused by the pressurized gas G passing through the annular space 115. The powder P and conveying gas are mixed to form a fluidized powder in the powder bore 110 downstream of the eductor nozzle 136.

Figure 4:
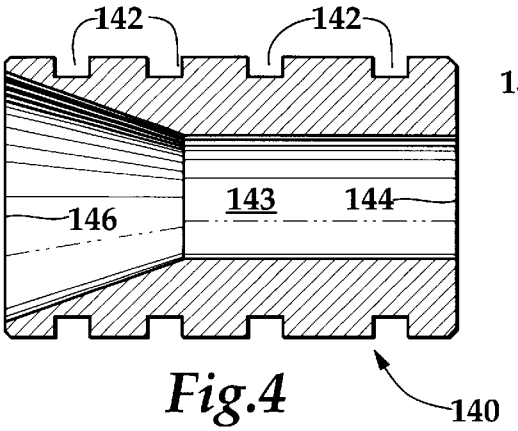
FIG. 4 is a cross section view of an adapter block for connecting a removable barrel to the body of the spray gun applicator of FIG. 2.

Referring now to FIG. 4 wherein adapter block 140 is illustrated in more detail. The adapter block 140 includes a plurality of concentric grooves 142 disposed on the exterior surface of the block. The grooves are adapted to receive a standard O-ring gasket to enhance the seal between barrel 150 and barrel end 108 of body 102. The adapter block 140 further includes a longitudinal axial bore 143 having a first portion 144 that is cylindrical and of the approximate same internal diameter as the powder bore 110. The second portion 146 of the bore tapers away from the central axis at approximately 20 degrees to an ultimate internal diameter at the discharge of approximately the same the internal diameter as the barrel 150. By referring again to FIG. 2, it will be understood by those skilled in the art, in embodiments as previously discussed wherein barrel 150 is formed integrally with body 102 or barrel 150 is connected to body 102 without an adapter block, that powder bore 110 would include a tapered portion transitioning from the internal diameter of the powder bore to the internal diameter of the barrel.

Figure 5A:
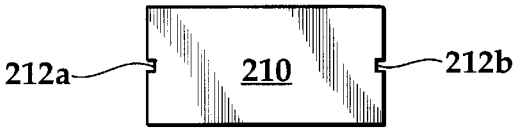
FIG. 5A is a plan view of an elongated sheet of polymeric material which may be used to form the charging element of the spray gun applicator of FIG. 2.
Figure 5B:
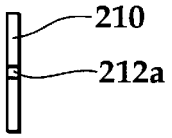
FIG. 5B is an end view of an elongated sheet of polymeric material which may be used to form the charging element of the spray gun applicator of FIG. 2.
Figure 5C:
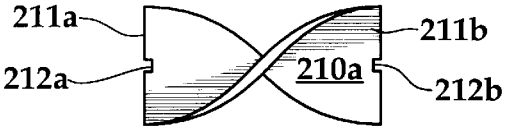
FIG. 5C is a plan view of the elongated sheet of FIG. 5A twisted clockwise to form a spiral charging element of the spray gun applicator of FIG. 2.
Figure 5D:
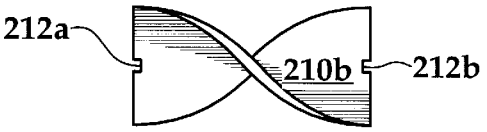
FIG. 5D is a plan view of the elongated sheet of FIG. 5A twisted counterclockwise to form a spiral charging element of the spray gun applicator of FIG. 2.
Figure 6:
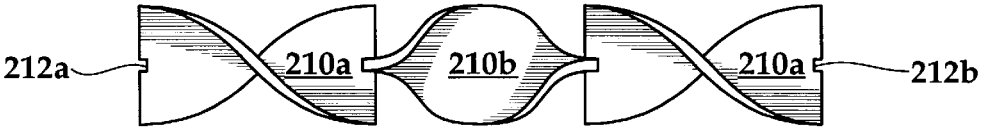
FIG. 6 is a plan view of a plurality of spiral charging elements positioned adjacent to one another for insertion into the barrel of the spray gun applicator of FIG. 2.

Referring now to FIGS. 2, 5A, 5B, 5C, 5D, and 6 therein are illustrated the component parts and assembly of the charge module 200 inside barrel 150 of the applicator device 100. The charge module 200 includes a plurality of charging plates elements 210*a, b*. Referring in particular to FIGS. 5A and 5B, therein are illustrated elongated polymeric sheets 210 that may be rectangular in shape. A pair of identical locking notches 212*a* and 212*b* are disposed axially and longitudinally on opposite ends of the sheets. FIG. 5C illustrates that a first end 211*a* of a first element 210*a* is twisted about its longitudinal axis with respect to the second end 211*b* so that a longitudinal edge of the element forms a spiral. In the preferred embodiment the first end 211*a* is twisted 180 degrees with respect to the second end 211*b* such that the two ends are again parallel. Likewise FIG. 5D illustrates that a first end 211*a* of a second element 210*b* is twisted about its longitudinal axis with respect to the second end 211*b* so that a longitudinal edge of the element forms a spiral. Referring now to FIG. 6, it can be seen that a plurality of charging elements 210*a* and 210*b* can be interconnected. In the preferred embodiment the first end 211*a* is twisted 180 degrees with respect to the second end 211*b* such that the two ends are again parallel. In the preferred embodiment, the distal end of a first element 210*a* abuts a proximal end of adjacent element 210*b* with the ends of each respective element being rotated about 90 degrees from the adjacent end. It will be appreciated by those skilled in the art that the sheets 210 may be formed into a spiral by heating and twisting or, alternatively, the charging element 210*a, b* may be injection molded. When assembled, the locking notch 212*a* engages locking notch 211*b*, whereby charging elements 210*a* and 210*b* are prevented from rotational movement with respect to one another. Referring again to FIG. 2, the charging elements 210*a* and 210*b* are assembled and inserted inside the central bore 152 of the barrel 150. In the preferred embodiment, at least three charging elements 210*a, b* are used to effect at least two flow reversals as the fluidized powder passes through the sequential charging elements prior to discharge from the distal end of the barrel 150. The charge module's unique geometry ensures that the particles moving through the gun are evenly distributed and such even distribution contributes to maximum contact with the charging elements 210*a, b* contributing to maximum powdered material charging as describe below. Furthermore, the even distribution of powdered material reduces surging of the discharged powdered material which contributes to a better discharge spray pattern.

As illustrated in FIG. 2, the barrel 150 further includes interchangeable spray tips 154 that determine various spray pattern characteristics that are well known in the art.

As further illustrated in FIG. 2, a conductive ground wire 180 is inserted through an opening 156 in the sidewall of the barrel 150. The wire 180 is attached at a first end to at least one of the charging elements 210 and to a ground source 182.

In operation, as heretofore described, polymeric powder P is drawn from an external supply and mixed with conveying gas G in the powder bore 110 to form a fluidized powder. The fluidized powder is propelled through the charging module 200 wherein the powder frictionally contacts the charging elements 210*a, b*. The frictional contact imparts a charge to the powdered material in the same manner as the leather soles of shoes pick up a static electrical charge from a polymeric carpet or the action of rubbing a balloon rapidly on a piece of silk or nylon cloth. The shoes or the balloon take on an electrostatic charge. The charged balloon will stick to most surfaces in which it comes in contact. In tribocharging spray guns, the powder particles are rubbed on specially formulated and shaped surfaces which allow charge to be transferred between the surface and the particles. The tribocharged polymeric material will cling to the substrate to which it is being applied. As the particles cover the substrate, the "magnet effect" gradually becomes weaker and the particles look for new clean areas to be attracted to, contributing to an even coat of powdered material on the substrate. The attractive force is sufficiently strong such that the powder will be delivered to locations outside the line of sight of the gun as the particles will travel around corners. Tribocharging is superior to electrostatic charging applicators because there are minimal external fields and no excess ion currents generated. The absence of an external field helps in the penetration of Faraday cage areas (cavities and recesses) and in conjunction with the absence of excess ion current contributes to smoother finishes and heavier film builds.

Since charge transfer occurs only at the small contact area of frictional impact, it is necessary to have many impacts to obtain a high charge level on the powder particles. The unique geometry of the present invention contributes to a tortuous flow path for the powdered material through the charge module 200. The flow path and the associated flow reversal contributes to greater contact between the powdered material P and the interior surfaces of the charging elements 210*a, b*, resulting in enhanced frictional contact, causing the powdered material to acquire additional charge from the charge module. The unique geometry of the charge module is one of the features that distinguish the present invention over the prior art.

Since the flow of powder through the tribocharge applicator is continuous, the transfer of charge is also continuous. This, in turn, requires that there be an effective path to ground for the continuous stream of charge removed from the powder. Without an effective "drain" to ground, the friction surface of the tribocharge elements 210*a, b* will either become saturated with charge and charging will stop, or the charge will build up and will arc to a nearby ground. This arcing can occur through an air path, along a surface, or it may actually punch through the wall of the barrel 150. In any case the effect is undesirable and potentially hazardous; therefore, the charging elements and gun are grounded with ground wire 182 as heretofore described in the detailed description.

Figure 7:
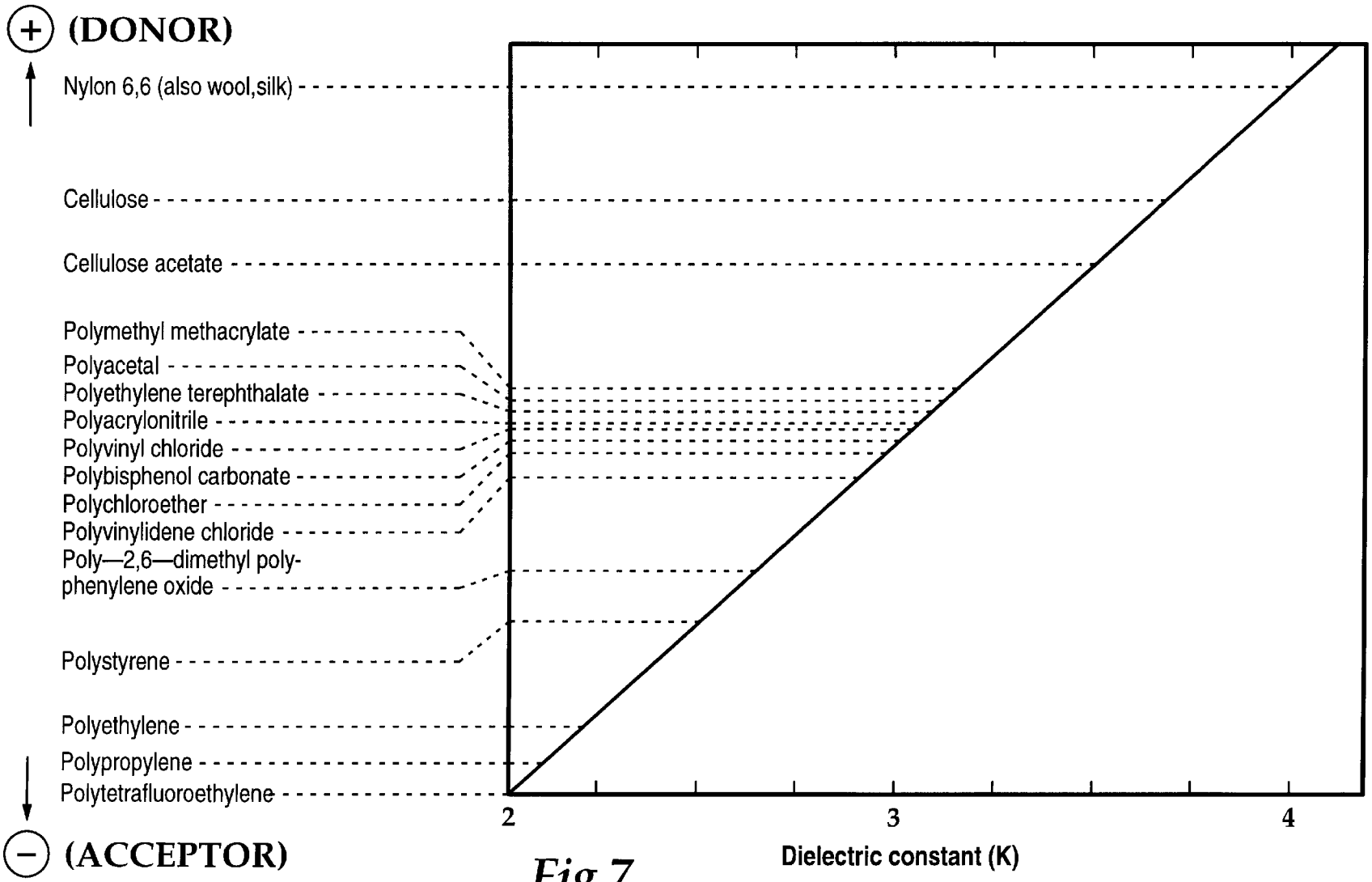
FIG. 7 is a graphical presentation of the tribo-electric relationship between various polymeric materials as function of dielectric constant.

Referring now to FIG. 9, the magnitude of the charge that the powdered material P receives is believed to be a function of the shape of the charging element and the difference in the dielectric constant of the powdered material and the dielectric constant of the material from which the charging elements are formed. The physics of tribocharging centers on the principle that under friction some material gives up electrons easily and that other material readily accepts electrons. Materials that most easily give up electrons (donors) are displayed at the top of FIG. 9 and those that most easily accept electrons (acceptors) are displayed at the bottom of FIG. 9. If a material that is a good donor is rubbed against one which is a good acceptor, electrons will be transferred and charging will occur. Thus, the farther apart materials are on the chart, the more charge will be transferred by contact between them. FIG. 9 is published as FIG. 10-7 in *Powder Coating—The Complete Finisher's*

*Handbook,* 1st ed. (Powder Coating Institute 1994) and is incorporated by reference herein.

TABLE 1

| POWDER TRIBO-ELECTRIC SERIES RELATIVE TO TEFLON ® | |
|---|---|
| + (DONOR) | Nylon (strongly positively charged) |
| | Epoxy |
| | Polyurethane |
| | Polyester-Copolymers |
| | Epoxy-Polyester Mix |
| | Polyester |
| | Polyvinyl Chloride (weakly positively charged) |
| − (Acceptor) | |

In the tribocharging series as described above, one of the best acceptors is polytetrafluoroethylene (Teflon®). Thus, almost any material that is rubbed on Teflon® will be charged positive. However, if the desired powdered material P is a better acceptor than Teflon®, then the resultant charge on the powdered material P will be negative. Preferred embodiments for the present invention include use of a polymethyl methacrylate powder material with a charge module fabricated from polytetrafluoroethylene (Teflon®); a modified polyethylene powder with a nylon charge module; and a nylon powdered material with a Teflon® charge module. It will be appreciated that materials other than those included on FIG. 9 may be used for the powdered material and the charge module; however, ideally the difference between the dielectric constant of the powder material and the dielectric constant of the material from which the charge module is greater than one. It will also be appreciated that the barrel 150 and the charging elements 210*a, b* may be formed from the same material or from different materials. It is understood that the tribocharge module of the present invention may be used with additional spray applicator devices and is not limited to the spray gun applicator disclosed herein but may be used with other powdered material delivery systems including conventional eductor systems such as is disclosed in U.S. Pat. No. 5,282,573, incorporated by reference.

Although a preferred embodiment of the invention has been illustrated in the accompanying Drawings and described in the foregoing Detailed Description, it will be understood that the invention is not limited to the embodiment disclosed but is capable of numerous modifications without departing from the scope of the invention as claimed.

We claim:

1. A tribocharge applicator device for application of a powdered material to a substrate, said apparatus including:

an inlet for pressurized conveying gas;

an inlet for powdered polymeric material having a first dielectric constant;

a mixing chamber; and a discharge barrel;

wherein the improvement comprises:

a charge module including:

at least two spiral charging elements disposed inside and coaxially aligned with respect to the barrel, each spiral charging element comprising an elongated sheet of a different material having a second dielectric constant, wherein a proximal end of said sheet is twisted about a longitudinal axis with respect to the distal end so that a longitudinal edge of said sheet forms a spiral, each charging element positioned within the barrel adjacent to another charging element such that a distal end of a first element abuts a proximal end of a second element wherein said first charging element defines a first spiral flow path and said second charging element defines a second spiral flow path rotationally opposite to the first spiral flow path to transfer an electric charge to the powdered polymeric material as the powdered material flows along each charging element.

2. The tribocharge applicator device of claim 1 including at least three spiral charging elements disposed inside and coaxially aligned with respect to the barrel, each charging element positioned within the barrel adjacent to another like element such that a distal end of a first element abuts a proximal end of a second element and the distal end of the second element abuts a proximal end of the third element, wherein said first charging element defines a first spiral flow path and said second charging element defines a second spiral flow path rotationally opposite to the first spiral flow and said third charging element defines a third spiral flow path rotationally opposite to the second spiral flow path to transfer an electric charge to the powdered polymeric material as the powder flows along and frictionally engages the charging element.

3. The tribocharge applicator claim 1 wherein the distal end of the first element abuts a proximal end of the second element and wherein the proximal end is rotated about 90 degrees relative to the distal end.

4. The tribocharge applicator of claim 1 further comprising a ground electrode connected to at least one of the charging elements.

5. The tribocharge applicator of claim 1 wherein the first end of the elongated sheet is twisted about the longitudinal axis about 180 degrees with respect to the second end such that the two ends are again parallel.

6. The tribocharge applicator of claim 1 wherein the charging element is formed from a material select from the group consisting of polytetrafluoroethylene, polyethylene and polypropylene and the polymeric powder material is formed from a material from the group comprising nylon or polymethyl methacrylate.

7. The tribocharge applicator of claim 1 wherein the charging element is formed from nylon and the powdered material is formed from polytetrafluoroethylene.

8. The tribocharge applicator of claim 1 wherein the first dielectric constant of the powdered material and the second dielectric constant of the material from which the charging element is formed differ by more than one.

9. The tribocharge applicator of claim 1 wherein the spiral charging element of the charge module further includes:

a locking notch positioned axially on each end of the sheet forming the spiral charging element, said locking notch of the distal end of the first element engages the locking notch of the proximal end of the second element thereby preventing rotational movement of the first charging element with respect to the second element.

10. A tribocharge applicator device for application of a powdered polymeric material having a first dielectric constant onto a substrate, said apparatus comprising:

a spray gun body including:

a grip handle, a breech end, a barrel end, a first internal passage for delivering pressurized conveying gas from an external source, a first opening in the breech for receiving a powder nozzle, and a powder bore having an inlet end located at the first opening in the breech and a discharge end located at the barrel end of the body;

a powder nozzle including:

a first end connected to an external supply of powdered material;

an internal bore for delivering powdered material, a second end positioned inside the powder bore of the body, an eductor nozzle disposed on the second end of the powder nozzle, said eductor nozzle including:

an axial passage open to the internal bore of the powder nozzle on both an inlet end and a discharge end, an outside diameter of the discharge end smaller than an internal diameter of the surrounding powder bore thereby creating an annular space, said annular space communicating with said first passageway providing pressurized conveying gas, wherein the powdered material is drawn from the external supply source through the internal bore of the powder nozzle, passes through the axial passage of the eductor and is discharged into the powder bore of the body by venturi effect of the pressurized gas passing through the annulus between the eductor nozzle and the powder bore, said pressurized gas and powder mixing to form a fluidized powder;

a valve for selectively controlling the flow of pressurized conveying gas to the eductor nozzle;

a barrel disposed on the barrel end of the body, said barrel having an internal bore in communication with the discharge end of the powder bore;

a charge module including:

at least two spiral charging elements disposed inside and coaxially aligned with respect to the barrel, each spiral charging element comprising an elongated sheet of a different polymeric material having a second dielectric constant, wherein a first end of said sheet is twisted about a longitudinal axis with respect to the second end so that a longitudinal edge of said sheet forms a spiral, each charging element positioned within the barrel adjacent to another charging element such that a distal end of a first element abuts a proximal end of a second element wherein said first charging element defines a first spiral flow path and said second charging element defines a second spiral flow path rotationally opposite to the first spiral flow path to transfer an electric charge to the powdered polymeric material as the powder flows along each charging element, and said charged fluidized power is discharged from the barrel of the gun onto the substrate.

11. The tribocharge applicator of claim 10 wherein the distal end of the first element abuts a proximal end of the second element and wherein the distal and proximal ends of the first and second elements are rotated about 90 degrees relative to each other.

12. The tribocharge applicator of claim 10 further comprising a ground electrode connected to at least one of the charging elements.

13. The tribocharge applicator of claim 10 wherein the first end of the elongated sheet is twisted about the longitudinal axis about 180 degrees with respect to the second end such that the two ends are again parallel.

14. The tribocharge applicator of claim 10 wherein the first dielectric constant of the powdered material and the second dielectric constant of the material from which the charging element is formed differ by more than one.

15. The tribocharge applicator device of claim 10 further including an interchangeable spray tip disposed on the distal end of the barrel for varying the spray pattern of the discharged fluidized powder.

16. The tribocharge applicator device of claim 10 further including a trigger pivotally attached to the body in proximity to the handle for actuating the valve for selectively controlling the flow of pressurized conveying gas to the eductor nozzle.

17. The tribocharge applicator device of claim 10 wherein the valve for selectively controlling the flow of pressurized fluid is located internally in the grip handle and is spring loaded and connected to the trigger by a piston mechanism.

18. The tribocharge applicator of claim 10 wherein the powder nozzle includes a portion externally threaded and is threadly engaged with an internally threaded portion of the powder bore of the body.

19. The tribocharge applicator of claim 10 further including interchangeable powder nozzles each nozzle having a different external diameter on the eductor nozzle, wherein the annular space between outside of the eductor nozzle and the inside of the powder bore is varied, whereby the flow rate and discharge pressure of the fluidized powder is adjusted.

20. The tribocharge applicator of claim 10 wherein the barrel is removably attached to the barrel end, wherein the barrel may be interchanged with barrels of differing internal diameters, whereby different diameter external diameter charge modules may be accommodated.

21. The tribocharge applicator of claim 10 further including an adapter block for connecting the barrel to the barrel end of the body.

22. The tribocharge applicator of claim 21 wherein the adapter block includes:

at least one groove adapted for a polymeric O-ring disposed on a first tubular portion of the block for engaging the internal bore of the barrel; and at least one groove adapted for a polymeric O-ring for engaging the powder bore.

* * * * *

UNITED STATES PATENT AND TRADEMARK OFFICE

CERTIFICATE OF CORRECTION

PATENT NO. : 5,885,351

DATED : March 23, 1999

INVENTOR(S) : Lloyd Bryan Long et al.

It is certified that error appears in the above-identified patent and that said Letters Patent is hereby corrected as shown below:

Column 1, line 67, change "grooves'" to –grooves,—;

Column 5, line 10, remove "plates" prior to –elements—;

IN THE CLAIMS

Claim 6, column 8, line 37, change "select" to –selected—;

Claim 10, column 9, line 53, change "power" to –powder—.

Signed and Sealed this
First Day of February, 2000

*Attest:*

Q. TODD DICKINSON

*Attesting Officer*

*Acting Commissioner of Patents and Trademarks*